United States Patent [19]

Brenner

[11] 4,018,536

[45] Apr. 19, 1977

[54] WRITING INSTRUMENT TOP

[75] Inventor: Arthur Walter Brenner, Cranston, R.I.

[73] Assignee: Anson Incorporated, Providence, R.I.

[22] Filed: Apr. 28, 1976

[21] Appl. No.: 681,341

Related U.S. Application Data

[63] Continuation-in-part of Ser. No. 624,662, Oct. 22, 1975.

[52] U.S. Cl. ..... 401/292; 40/334

[51] Int. Cl.[2] ..... G09F 3/00

[58] Field of Search ..... 401/292, 194, 198, 124, 401/213, 243–247, 262, 269; 40/334; 29/515, 518; 403/280

[56] References Cited

UNITED STATES PATENTS

| | | | |
|---|---|---|---|
| 1,514,002 | 11/1924 | Kraker | 40/334 |
| 2,272,139 | 2/1942 | Tapner | 40/334 |

FOREIGN PATENTS OR APPLICATIONS

| | | | |
|---|---|---|---|
| 781,594 | 2/1935 | France | 40/334 |
| 66,881 | 5/1957 | France | 40/334 |
| 13,900 | 6/1907 | United Kingdom | 401/194 |
| 19,506 | 8/1910 | United Kingdom | 40/334 |

*Primary Examiner*—Lawrence Charles
*Attorney, Agent, or Firm*—William Frederick Werner

[57] ABSTRACT

The present disclosure relates to writing instrument tops as an article of manufacture and specifically to an improved construction and the method of making the same.

3 Claims, 5 Drawing Figures

WRITING INSTRUMENT TOP

BACKGROUND OF THE INVENTION

The present invention is a continuation-in-part of United States patent application Ser. No. 624,662 filed Oct. 22, 1975 for a Writing Instrument Top.

STATEMENT OF INVENTION

The present invention relates to a novel construction and a new esthetic appearance in writing instrument tops and the method of making the same.

Mechanical writing instruments of the propel-repel type comprise two inter-related tubes. One tube provided with the writing end is termed the body. The other tube removably secured to the body is termed the top. The propel-repel mechanism may be located in the body or in the top. In either event, the lower end of the body is provided with the writing element which provides a closure member for the lower end of the tube body. The upper end of the tube body is normally open and is constructed, so as to removably secure the top to the body.

The lower end of the top tube is open and adapted to cooperate with the open upper end of the body tube, so as to be removably secured thereto.

There has always remained a problem of what to do with the open upper end of the top tube. In some instances, the top end is swedged over to close the top. In other instances, structures were built on to the top to provide fluid seals against ink leakage or to provide a fanciful end. The material from which the body and top are fabricated and the sale price of the writing instrument are important factors to consider in determining the nature of the closure for the open ended top.

The writing instrument, when the body and top are fabricated from sterling silver or gold-rolled, or gold-filled attached to a base metal is classed as an article of jewelry. The top must therefore present an esthetic appearance to provide sales appeal and a price beyond that of a lead pencil or inexpensive ball point pen.

Various types of plugs and configurations have been provided to close the open end of the top. Such plugs and configurations have then been used as symbols to indicate the source of manufacture and thereby have become trade marks. No consideration was given to the personality of the individual who ultimately purchased the article of jewelry for personal use.

In prior applications by the present inventor an ornament was used as a closure element. In one form, the ornament was held in the open end of the top by means of a shelf counter bored into the inner wall of the tube. The ornament provided with tapered sides was placed within the tube, against the shelf. The tube was swedged against the tapered sides of the ornament to fasten the ornament therein. People dropped the writing instrument or drummed the top against a desk top. Such action dislodged the ornament due to the delicate wall thinness which yielded to shock.

In another form, a shelf was provided in the inner wall of the tube. A ferrule provided with a ledge was placed within the tube with the ledge engaging the shelf to reinforce the tube wall and absorb the shock produced by drumming or dropping. An ornament provided with tapered sides was inserted within the tube and against the top of the ferrule. The sides of the tube were forced against the tapered sides of the ornament to fasten the ornament in position. The ornament could only be removed if the tapered sides of the tube were dislodged. This resulted in the destruction of the top.

OBJECTS OF THE INVENTION

It is an object of the present invention to fortify the wall of the top and at the same time provide means to removably secure an ornament in the top.

Another object of the present invention is to reduce the cost of providing an ornament as a closure for a writing instrument top while retaining the benefits of the structural features of prior constructions.

Still another object of the present invention is to provide a new writing instrument top construction and the method of providing the same.

Other objects of the present invention will become apparent in part and be pointed out in part in the following specification and claims.

BRIEF DESCRIPTION OF THE DRAWINGS

Like reference numerals refer to like parts in the following drawings in which.

DESCRIPTION OF THE PREFERRED EMBODIMENT

Figure 1:
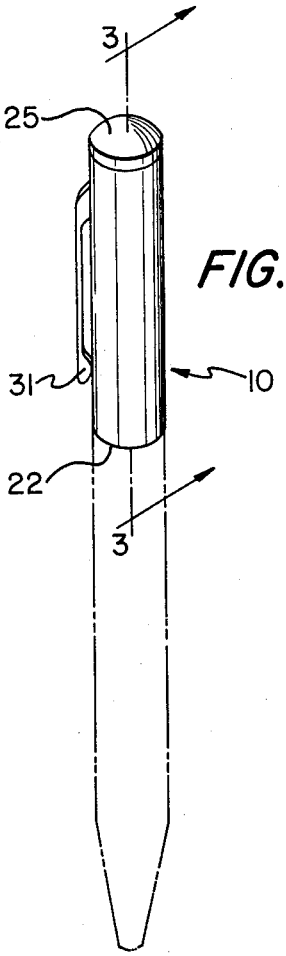
FIG. 1 is a perspective view of the new and improved writing instrument top.
Figure 2:
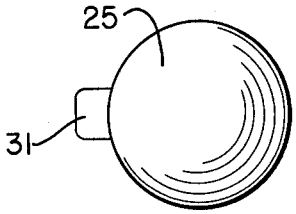
FIG. 2 is a top plan view of FIG. 1.

It is pointed out that the top (and body) are of a fragile nature due to their fabrication from precious metal and also due to the fact that a writing instrument must be very light in weight in spite of the propel-repel mechanism located within the body and/or top. The thickness of the tube constituting the top must be very thin in order to be very light in weight.

Reference is made to all of the figures wherein is illustrated a tube 10 of preselected length, having a top end 21 and a bottom end 22, and having a wall 11 provided with an inside surface 23, of preselected dimension, forming an axial passageway 12.

A ferrule (by definition a short bushing for tightening or reinforcing a joint) generally indicated by reference numeral 15 comprises a circular surface 17, having a preselected dimension to provide a "press fit" with said inside surface 23, a circular recess or "O" ring groove 16, a circular ledge 20, and a top 25 of preselected ornamentation. Top 25 may be an integral part of ferrule 15 or it may be a separate part fastened to ferrule 15. Top 25 may be of any selected geometric shape or ornamentation. The ornamentation may be a precious stone, a birth stone, a fraternity, society or religious insignia.

An O ring 18 is provided in circular recess 16.

Figure 3:
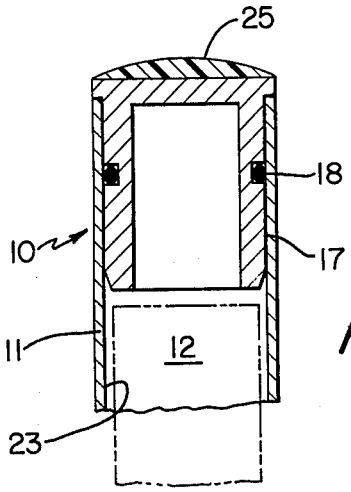
FIG. 3 is a fragmentary cross sectional view taken on line 3—3 of FIG. 1, showing an ornament fastened within the upper opening of the top.
Figure 4:
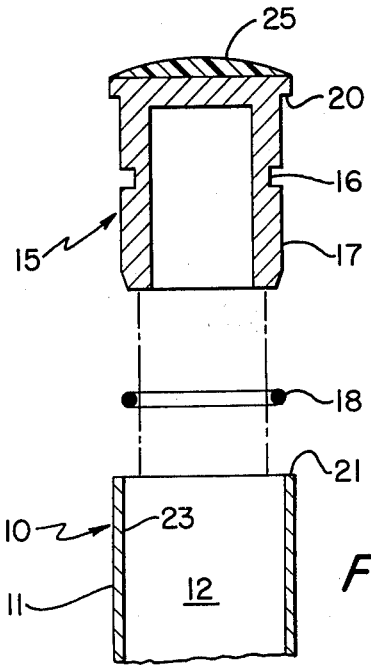
FIG. 4 is an exploded view, showing the several parts which form the assembly shown in FIG. 3.
Figure 5:
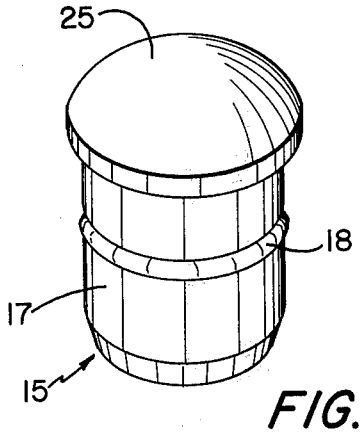
FIG. 5 is a perspective view of the new and improved insert.

In assembling, ferrule 15 is pushed into tube 10 with O ring 18 engaging inside surface 23 and with ledge 20 abutting top edge 21 of tube 10. In this manner ferrule 15 is locked within tube 10. A probe 27, shown in dot and dash lines in FIG. 3, may be used to unlock or force ferrule 15 out of tube 10.

The dot and dash lines in FIG. 1 indicate a writing instrument body. A clip 31 may be fastened to tube or top 10.

Having shown and described a preferred embodiment of the present invention, by way of example, it should be realized that structural changes could be made and other examples given without departing from either the spirit or scope of this invention.

What I claim is:

1. A writing instrument top comprising a tube having a top end and a bottom end, and a wall provided with an inside surface forming an axial passageway, a ferrule provided with a circular surface, a circular recess, a circular ledge, and a top, an O ring located in said circular recess, said ferrule positioned in said axial passageway with said O ring engaging said inside surface, and said circular ledge abutting said top end to removably secure said ferrule in said tube.

2. A writing instrument top according to claim 1, wherein said circular surfaces engages said inside surface with a press fit.

3. In the manufacture of a writing instrument top, the method comprising the steps of:

a. selecting a tube of preselected length, having a top end and a bottom end, and having a wall provided with an inside surface, of preselected dimension, forming an axial passageway, b. providing a ferrule with a circular surface having a preselected dimension to provide a press fit with said inside surface, a circular recess, a circular ledge, and a top of preselected ornamentation, c. providing an O ring in said circular recess, d. inserting said ferrule in said axial passageway with said O ring engaging said inside surface to lock said insert insert in said tube and with said circular ledge abutting said top end to provide a removable insert in said tube.

* * * * *